US005568838A

United States Patent [19]

Struthers et al.

[11] Patent Number: 5,568,838

[45] Date of Patent: Oct. 29, 1996

[54] BIT-STABILIZED COMBINATION CORING AND DRILLING SYSTEM

[75] Inventors: Barry W. Struthers, Humble; Pierre E. Collee, Kingwood, both of Tex.

[73] Assignee: Baker Hughes Incorporated, Houston, Tex.

[21] Appl. No.: 311,118

[22] Filed: Sep. 23, 1994

[51] Int. Cl.[6] ..... E21B 10/02; E21B 25/02; E21B 47/00; E21B 47/12

[52] U.S. Cl. ..... 175/246; 175/50; 175/58; 175/226; 175/405.1

[58] Field of Search ..... 175/246, 244, 175/247, 239, 236, 405.1, 403, 434, 58

[56] References Cited

U.S. PATENT DOCUMENTS

| | | | |
|---|---|---|---|
| 2,708,103 | 5/1955 | Williams, Jr. | 175/246 |
| 3,127,943 | 4/1964 | Mori | 175/246 |
| 3,241,624 | 3/1966 | Rassieur | 175/246 X |
| 3,481,412 | 12/1969 | Rowley | 175/247 |
| 3,548,958 | 12/1970 | Blackwell et al. | 175/25 |
| 3,951,219 | 4/1976 | Cortes | 175/246 X |
| 4,466,497 | 8/1984 | Soinski et al. | 175/246 |
| 4,773,489 | 9/1988 | Makohl | 175/246 X |
| 4,815,342 | 3/1989 | Brett et al. | 76/108.4 |
| 4,955,438 | 9/1990 | Juergens et al. | 175/40 |
| 4,981,183 | 1/1991 | Tibbitts | 175/244 |
| 4,982,802 | 1/1991 | Warren et al. | 175/57 |
| 5,009,273 | 4/1991 | Grabinski | 175/61 |
| 5,010,789 | 4/1991 | Brett et al. | 76/108.2 |
| 5,020,612 | 6/1991 | Williams | 175/234 |
| 5,029,653 | 7/1991 | Jurgens et al. | 175/58 |
| 5,038,873 | 8/1991 | Jurgens | 175/246 |
| 5,042,596 | 8/1991 | Brett et al. | 175/57 |
| 5,090,492 | 2/1992 | Keith . | |
| 5,099,934 | 3/1992 | Barr | 175/393 |
| 5,103,921 | 4/1992 | Zeer et al. | 175/81 |
| 5,109,935 | 5/1992 | Hawke | 175/434 |
| 5,111,892 | 5/1992 | Sinor et al. | 175/65 |
| 5,119,892 | 6/1992 | Clegg et al. | 175/431 |
| 5,131,478 | 7/1992 | Brett et al. | 175/57 |
| 5,165,494 | 11/1992 | Barr | 175/376 |
| 5,178,222 | 1/1993 | Jones et al. | 175/398 |
| 5,253,720 | 10/1993 | Radford et al. | 175/58 |
| 5,322,135 | 6/1994 | Travis | 175/58 |
| 5,339,915 | 8/1994 | Laporte et al. | 175/244 |
| 5,351,765 | 10/1994 | Ormsby | 175/58 |

OTHER PUBLICATIONS

Sinor, L. A., et al. "Development of an Anti–Whirl Core Bit" Society of Petroleum Engineers, pp. 413–425, 1992.

Eastman Christensen Catalog, "Slimhole Coring", undated.

*Primary Examiner*—Stephen J. Novosad

*Attorney, Agent, or Firm*—Trask, Britt & Rossa

[57] ABSTRACT

A core barrel having an inner tube for coring and, alternately, a center plug assembly or closing the throat of the core bit at the bottom of the assembly for drilling in lieu of coring. The inner tube assembly and plug assembly are disposable and retrievable through the drill string on a wireline using an overshot. The core bit is of a stabilized, preferably anti-whirl, design and may be a low-invasion core bit used in cooperation with a low-invasion coring shoe. A logging tool and data transmission assembly may be incorporated in the plug assembly for logging while drilling.

20 Claims, 4 Drawing Sheets

BIT-STABILIZED COMBINATION CORING AND DRILLING SYSTEM

BACKGROUND OF THE INVENTION

1. Field of the Invention

The present invention generally relates to wireline coring of subterranean formations, and more specifically to a bit-stabilized combination coring and drilling system offering interchangeable placement and retrieval of coring inner tube assemblies and drilling plug assemblies for drilling ahead, the latter also being optionally provided with logging capabilities.

2. State of the Art

Wireline coring has been known for many years. The basic concept of wireline coring involves the use of a core barrel including an outer barrel assembly disposed at the end of a drill string and having a core bit or crown at the bottom thereof. An inner tube assembly for receiving a core cut by the core bit is releasably latched into the outer barrel assembly. This arrangement permits placement of the inner tube assembly in the outer barrel assembly by wireline, gravity, or hydraulic flow, and retrieval thereof from the outer barrel assembly via wireline. Examples of such prior art wireline coring systems are disclosed in U.S. Pat. Nos. 3,127,943 and 5,020,612, incorporated herein for all purposes by this reference.

One problem with many such prior art systems is the necessity of using a special drill string having an enlarged diameter to accommodate running and retrieval of an inner tube assembly used to cut relatively large cores in excess of two inches in diameter.

While coring systems cutting small or "slim-hole" cores of 1 ¾" or less in diameter are known, it will be appreciated that such cores are extremely fragile and conventional coring systems are limited in the length that such cores can be reasonably cut without fracturing. This limitation appears to be primarily due to instability of the entire core barrel initiated by lateral and vertical bit movement in the borehole, which produces vibration. A major phenomenon resulting from such bit movement and vibration is so-called bit "whirl", although vibration without whiff is still detrimental. The phenomenon of bit "whiff" is exhibited in bits have unbalanced cutter side forces, which forces cause the bit to rotate or "whirl" in the borehole about a center point offset from the geometric center of the bit in such a manner that the bit tends to whirl backwards about the borehole. The whirl phenomenon has been observed to be aggravated by the presence of gage cutters or trimmers at certain locations on the outer gage of the bit, such cutters also generating frictional forces during drilling. Whirl is a dynamic and self-sustaining phenomenon, and in many instances is highly destructive to the drill bit cutters. The whirl phenomenon also causes spiraling of the borehole during drilling which results, in core bits, in a non-cylindrical, spiraled core which is more susceptible to fracture, and jamming in the core barrel inner tube.

Given the relatively small clearances between the core and the pilot shoe, core catcher and inner tube components of the inner barrel, slight lateral and vertical movements of the core barrel easily result in fracture of small-diameter cores with attendant core jamming and degradation of the core sample. As a result, small diameter core barrels have been traditionally limited in length due to the short (for example, ten to thirteen foot) core Samples which could be cut without experiencing the aforementioned core fracture, jamming and degradation. Attempts have been made to cut longer cores, as long as twenty-six feet, but the apparatus employed has never been deemed successful due, again, to the aforementioned problems.

It has been recognized that certain recent improvements in bit design, including but not limited to the so-called "anti-whirl" polycrystalline diamond compact (PDC) cutter bits initiated by Amoco and improved by the assignee of the present invention, could be applied to core bits to enhance the reliability of a coring operation and the quality of the cores. Patents disclosing anti-whirl bits include, without limitation, U.S. Pat. Nos. 4,982,802; 5,010,789; 5,042,596; 5,099,934; 5,109,935; 5,111,892; 5,119,892; 5,131,478; 5,165,494; and 5,178,222, the disclosures of which are incorporated herein by this reference. SPE (society of Petroleum Engineers) Paper No. 24587 by L. A. Sinor et al of Amoco Production Co., entitled "Development of an Anti-Whirl Core Bit", discusses improvements and potential improvements in coring capability thought to be offered through the use of anti-whiff core bits.

Other approaches to bit stabilization have been taken, by Amoco as well as others. One approach is to attempt to perfectly balance a bit, as disclosed in U.S. Pat. No. 4,815,342, the disclosure of which is incorporated herein by reference. Another approach is to mechanically "lock" the projections on the bit face into circular grooves cut by the cutters on the face, as disclosed in U.S. Pat. No. 5,090,492, the disclosure of which is incorporated herein by reference.

All of the foregoing developments in bit stabilization have been focused on discrete elements of the drilling operation, either drilling a full-gage wellbore or in coring.

Some years ago, Eastman Christensen Company, a predecessor to the assignee of the present invention, developed a combination drilling and coring system having a "Drill-Core System" option, which allowed for alternate coring and drilling operations without tripping the drill string. In the Drill-Core System, both the inner barrel assembly for coring and a substitute center plug assembly with a crowsfoot and cutters for converting the core bit to a drill bit were deployable and retrievable via wireline. The Drill-Core System employed natural diamond core bits, and was only marginally successful for several masons. First, the maximum core length which could be cut at one time was only thirteen feet, providing an extremely short interval for analysis without multiple trips of the inner tube assembly, and requiting combination with odd-length tubulars to drill the kelly down to the rotary table like a pipe joint. In addition, the advent of more accurate electric well logs and analysis techniques for logging data reduced the demand for core analysis. Finally, the industry was not accepting of the relatively small diameter cores (2") taken by the system, which was required in order to deploy and retrieve the inner barrel assembly and center plug assembly through standard tubular goods.

In recent years, however, the development and industry acceptance of punch-and rotary-type sidewall coring techniques which result in 1" diameter cores from the side of the borehole being drilled, as well as the increased use of slim-hole drilling for exploratory wells has eliminated the prior hesitancy to accept and rely upon small-diameter cores. These changes in industry practices have resulted in a renewed interest in coring, but to date state of the art coring systems have not offered an acceptable slim-hole coring and drilling system, which can cut pristine, undamaged cores of a desirable length (for example, thirty feet), substantially avoid core jamming, and also provide a capability for drilling ahead between intervals to be cored without tripping the drill string. Moreover, no state of the art coring system offers performance capabilities and operating characteristics similar to those of PDC drill bits.

SUMMARY OF THE INVENTION

The present invention offers the capability of alternately coring and drilling without tripping the drill string and for taking extended-length small diameter cores.

The core barrel of the invention includes an outer barrel assembly having a PDC core bit disposed at the lower end thereof and a bit end beating assembly immediately above the core bit within the core barrel for alternately receiving the end of an inner tube assembly or a center plug assembly. A latch coupling is located on the upper interior of the outer barrel assembly. The inner tube assembly includes an overshot coupling member at the upper end, a latch assembly therebelow for engaging the outer barrel latch coupling, and a bearing assembly below the latch assembly for permitting rotation between the outer barrel assembly and the inner tube. The lower end of the inner tube assembly, which engages the bit bearing assembly, includes a conventional core catcher.

The PDC core bit employed in the invention is preferably of an anti-whirl design, although other stabilized bit designs such as discussed above may also be suitable. Employing an anti-whirl core bit in the invention results in the demonstrated capability to cut and pull at least thirty foot cores of high quality and greatly increased recovery rate. Moreover, the use of a PDC core bit with optional center plug affords a rate of penetration (ROP) similar to that of PDC drill bits, and weight-on-bit (WOB), rotational speed and hydraulic flow rates similar to that of PDC drill bits. Thus, large quantities of high quality cores may be obtained cost-effectively and the overall ROP during the drilling operation is not substantially reduced in comparison to drilling without coring, the operator benefitting from time and cost savings as well as from the information available from the high quality cores.

The use of the bit end bearing assembly results in precise alignment of the inner tube to receive the core being cut as well as a seating arrangement for the lower end of the center plug assembly which contains a plurality of PDC cutters and fluid outlets for drilling fluid.

An optional but significant feature of the present invention is the disposition of a suitable logging tool, such as a gamma ray or directional logging tool, in the center plug assembly to permit the conduct of a logging-while drilling operation. Data may be stored in the logging tool while drilling and periodically retrieved by wireline transmission or when the center plug assembly is retrieved to the surface, or a mudpulse or other suitable data transmission system may be incorporated as part of the center plug assembly to permit real-time transmission of data. One or more sensing capabilities may be included in the tool, such capabilities including, without limitation, pressure and temperature measurement in addition to the others mentioned above.

DETAILED DESCRIPTION OF THE PREFERRED EMBODIMENT

Figure 1:
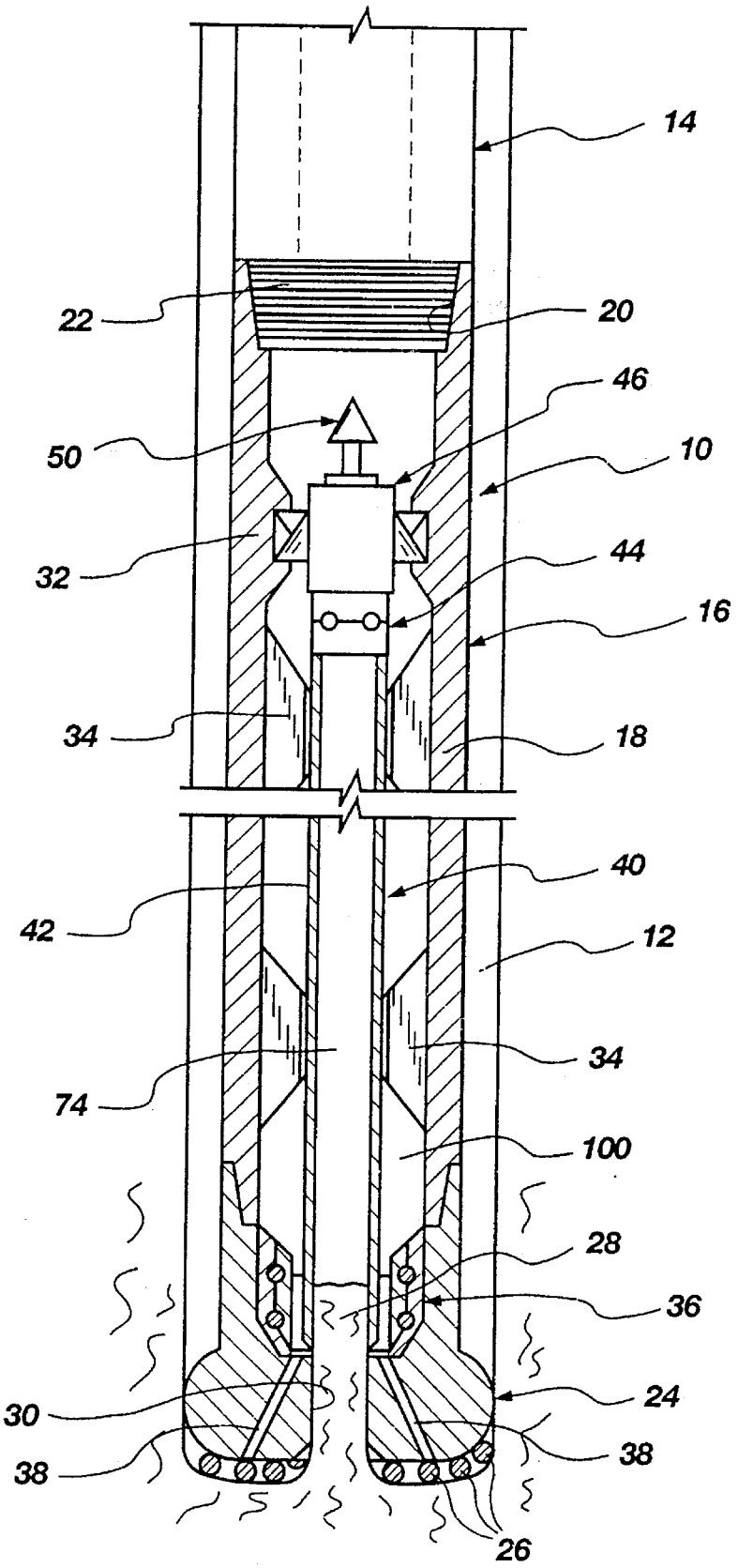
FIG. 1 is a schematic sectional side elevation of the core barrel of the present invention.

Referring now to FIG. 1 of the drawings, core barrel 10 of the present invention is depicted suspended in borehole 12 from drill collar 14 at the bottom of a drill string extending to the surface.

Core barrel 10 includes outer barrel assembly 16 having a tubular outer barrel 18. At the top of outer barrel 18 is a threaded box connection 20 for securing core barrel 10 to the threaded pin connection 22 of drill collar 14. Secured to the bottom of barrel 18 is a PDC core bit 24 of an anti-whiff or other stabilized design, as described previously. PDC cutters 26 on core bit 24 cut the formation as the drill string is rotated, and also cut a core 28 from the formation being drilled, the core 28 extending upwardly into the throat 30 of core bit 24 as the bit drills ahead into the formation. If desired, the core bit 24 may be of the low-invasion type, as disclosed and claimed in U.S. Pat. No. 4,981,183, assigned to the assignee of the present invention and incorporated herein by this reference. On the interior of barrel 18 is a latch coupling 32, below which are a plurality of axially-spaced groups of bearing ribs 34, the rib groups extending circumferentially around the interior of barrel 18. Within the interior of core bit 24 is a bit end rotational bearing assembly 36. Fluid passages 38 extend from the bit interior to the bit face.

Inner tube assembly 40 is shown disposed within core barrel 10 as it would be during a coring operation. Inner tube assembly 40 includes an inner tube 42 at the lower end thereof, which is received within bit end rotational bearing assembly 36. Inner tube 42 extends upwardly within outer barrel 18 through the groups of bearing ribs 34, which provide support against sagging and flexing of inner tube 42. At the top of inner tube 42 is inner tube bearing assembly 44, which permits the upper and lower portions of inner tube assembly 40 to rotate with respect to one another, and thus with bit end bearing assembly 36 allows outer barrel assembly 16 to rotate while inner tube assembly remains stationary. Above beating assembly 44, latch assembly 46 releasably engages latch coupling 32 on the interior of outer barrel 18. At the top of inner tube assembly 40, an overshot coupling 50 is located for selective engagement and release of the inner tube assembly 40 by a wireline overshot.

Figure 2:
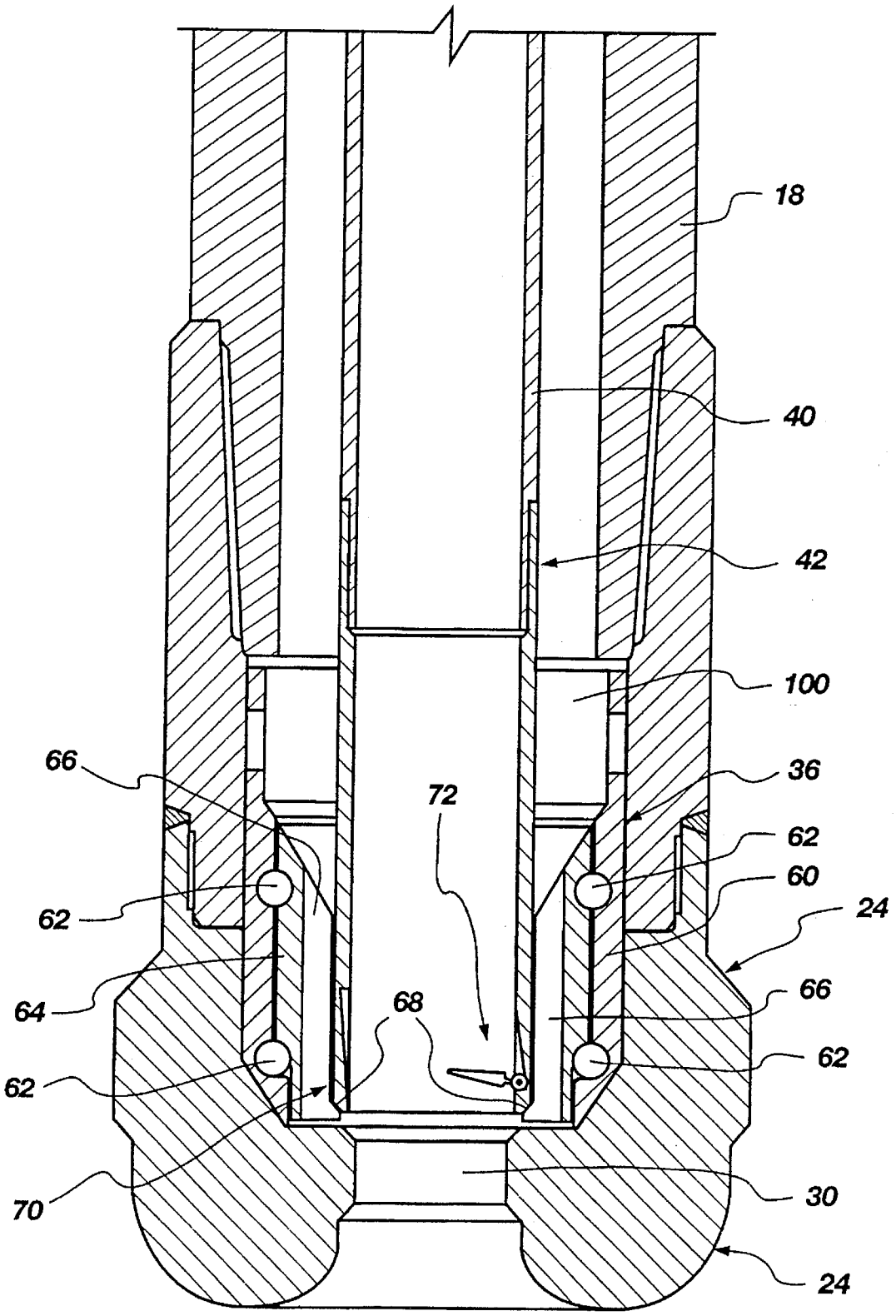
FIG. 2 is an enlarged side sectional elevation of the lower end of the core barrel of the invention with the inner tube assembly in place for coring.
Figure 3:
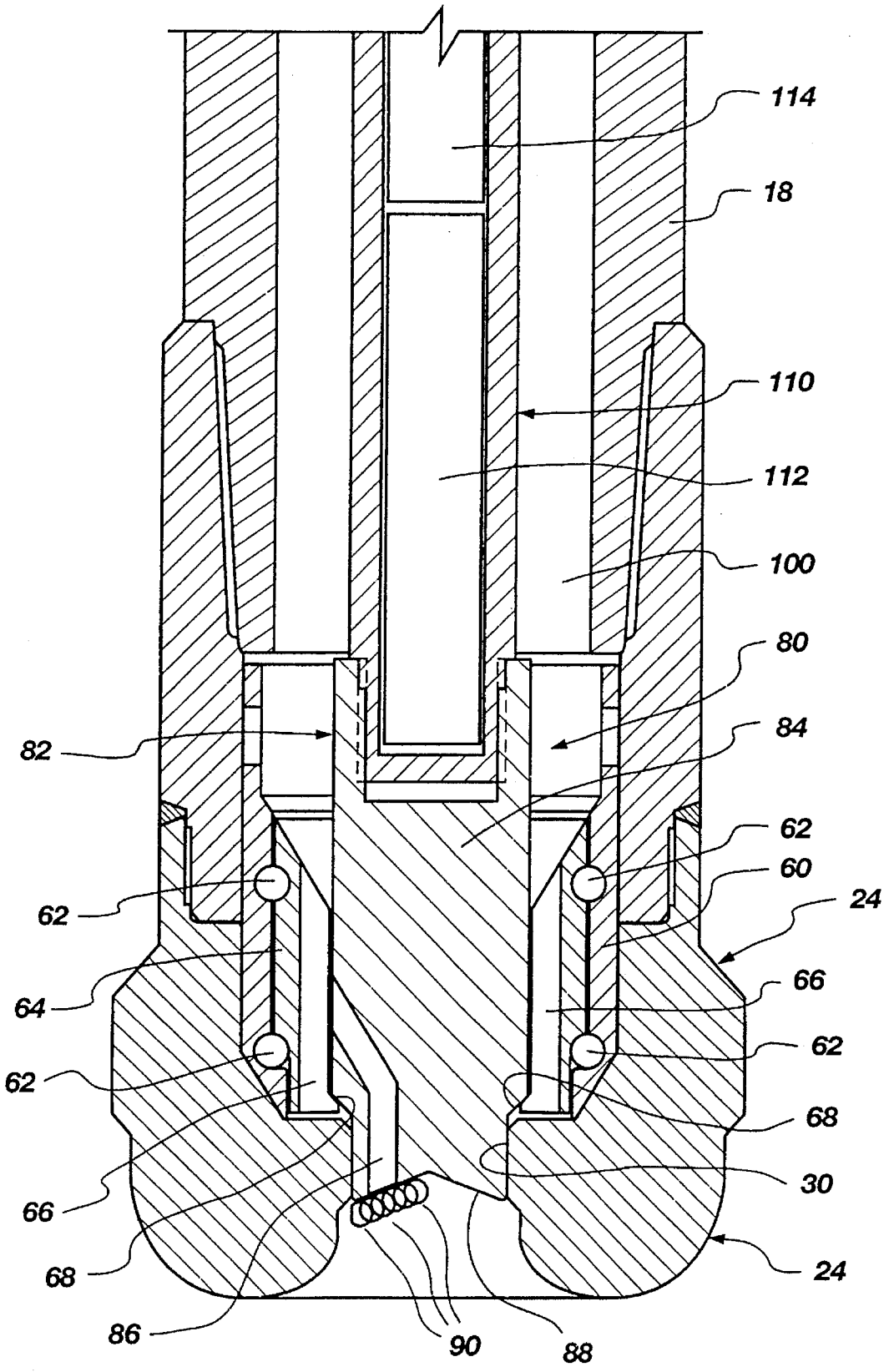
FIG. 3 is an enlarged side sectional elevation of the lower end of the core barrel of the invention with the center plug assembly in place for drilling.

Referring now to FIG. 2 and 3 of the drawings, components which have been previously identified with respect to FIG. 1 will be designated by the same reference numerals to avoid confusion.

As shown in FIG. 2, bit end beating assembly 36 includes an outer housing 60, bearings 62, and an inner housing 64 which freely rotates with respect to outer housing 60 due to bearing 62. Ribs 66 having beveled shoulders 68 at their lower ends extend radially inwardly from inner housing 64, ribs 66 and shoulders 68 laterally and axially supporting the lower end of inner tube assembly 40 thereon. The space between ribs 66 permits drilling fluid to flow into throat 30 of core bit and around the core 28 during coring. If this flow is not desired, a low-invasion core bit and cooperating shoe design of the type disclosed in the above-referenced '981 patent and illustrated in FIG. 5 of the drawings may be employed to minimize drilling fluid contact with the core. At the lower end of inner tube 42, either a wedge-type core catcher 70 as shown on the left-hand side of the drawing or a basket-type core catcher 72 as shown on the right-hand side of the drawing (both as known in the art) may be employed. PDC cutters 26 have been omitted from FIG. 2, but as shown in FIG. 1 they are disposed on core bit 24 so as to cut a core sized to move upwardly in throat 30 of core bit 24 and into the bore 74 of inner tube 42.

Referring now to FIG. 3 of the drawings, in lieu of inner tube assembly 40, center plug assembly 80 is shown disposed in outer barrel assembly 16. Center plug assembly 80 includes at the upper end thereof a latch assembly (not shown) similar to that of inner tube assembly 40, to engage the latch coupling 32 of outer barrel 18, as well as an overshot coupling 50 for placement and retrieval of the center plug assembly 80. No rotational bearing assembly is included in plug assembly 80, as rotation thereof with respect to outer barrel assembly 16 is not required or desired. Bit plug 82 is disposed at the bottom of plug assembly 80, and is supported by bit end bearing 36 in the same manner as inner tube assembly 40. Bit plug 82 includes a plug body 84 having passages 86 therethrough for conducting drilling fluid to plug face 88 where PDC cutters 90 are located. Plug body 84 is sized to be received and supported laterally and axially by ribs 66 and shoulders 88 of inner housing 64 of bit end bearing assembly 36. The spaces between ribs 66 permit drilling fluid to flow into passages 86, as shown.

When it is desired to core with the apparatus of the present invention, the inner tube assembly 40 is run into the drill string on a wireline and latched into outer barrel assembly 16. Drilling fluid is then circulated down the drill string and into the annulus 100 between the inner tube assembly and outer barrel assembly 16, where it exits from the face of core bit 24 through conventional fluid passages and nozzles (not shown) to clean and cool the cutters and clean the bit face as the string is rotated and the formation and core are cut. When the maximum core length is reached, the inner tube assembly is pulled from the borehole via a wireline having an overshot at the end of it to engage coupling 50, and another inner tube assembly tripped into the drill string if further coring is desired.

If it is desired to drill instead of core, center plug assembly 80 is run into the borehole on wireline via an overshot which engages a coupling 50 at the top of the assembly. The assembly 80 then latches into the outer barrel 18, after which drilling fluid pumped down the drill string into the annulus 100 between the plug assembly 80 and the outer barrel 18 and through passages 86 in plug body 84 to bit face 88 to cool and clean PDC cutters 90 and remove formation debris as the core barrel 10 is rotated and drilling proceeds.

If desired, plug assembly 80 may be provided with a pressure barrel or housing 110 within which reside a logging tool 112 such as a gamma ray tool or a directional tool for sensing the path of the borehole, for the conduct of logging while drilling. Also if desired, a data transmission assembly 114 may be disposed in pressure housing 110, the former comprising an electronic transmission assembly or a mud-pulse type assembly (in which case part of it would naturally be external to pressure housing 110) for real-time transmission of logging data to the surface via wireline or mud-pulse. Alternatively, data might be retrieved periodically by wireline, or when assembly 80 is pulled from the hole.

It is also contemplated that pressure and temperature sensors may be carded in pressure barrel 110. The former are particularly desirable to measure dynamic pressure loss and thus flow rate to ascertain the flow rates suitable for coring when the center plug assembly 80 is replaced with inner tube assembly 40. By calculating or measuring hydrostatic pressure in the borehole annulus and measuring total pressure near the bit from barrel 110, the dynamic pressure loss and thus flow rates can be ascertained so as to reduce or preferably eliminate core erosion and wash out.

Temperature measurement is particularly desirable and useful if a gel coring operation is conducted, with non-invasive gel for encapsulation of the core sample being pre-placed within inner tube 42 before running into the drill string. The temperature-sensitive nature of such gels and their ability to increase viscosity and even substantially solidify over a relatively narrow temperature range drop renders the ability to measure core barrel-depth temperature measurement an extremely desirable capability, so as to permit formulation or selection of a gel which will viscosify at the desired depth and not prematurely. A more complete explanation of the formulation and use of non-invasive gels for core sample encapsulation is contained in co-pending U.S. patent application Ser. No. 08/051,093, filed Apr. 21, 1993, and assigned to the assignee of the present invention. The disclosure of the '093 application is incorporated herein by this reference.

Figure 4:
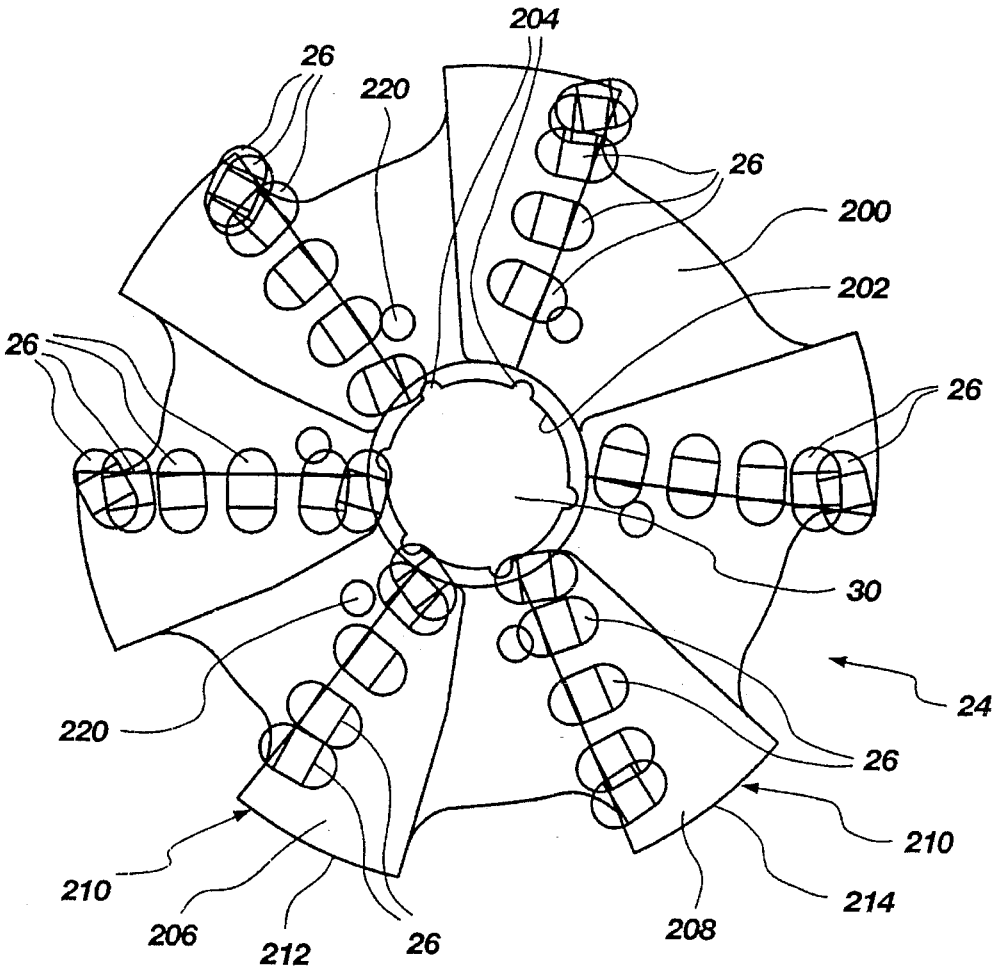
FIG. 4 is a schematic elevation showing cutter placement and looking downward through the bit face of an anti-whiff core bit suitable for use with the present invention.

Referring now to FIG. 4 of the drawings, exemplary anti-whirl core bit 24 is illustrated, looking downward through the bit face 200 as it would be oriented in the borehole. Placements of PDC cutters 26 are schematically shown on bit face 200, certain cutters 26 extending radially inwardly from inner gage 202 defining throat 30 of bit 24, whereby a core may be cut of less diameter than that of throat 30. Channels 204 are placed about the inner gage 202 to permit drilling fluid flow, if desired, past the exterior of the core. Other fluid passages 220 extend through bit face 200. While anti-whirl bits are now well known in the art, it should be noted that blades 206 and 208 of core bit 24 are devoid of cutters at outer gage 210, and that gage pads 212 and 214 on blades 206 and 208 are used as bearing surfaces for core bit 24 to ride against the wall of the borehole. Selected size, placement and orientation of cutters 26 on bit face 200 results in a cumulative directed side or lateral force vector oriented in a direction perpendicular to the bit axis and between blades 206 and 208, causing gage pads 212 and 214 to ride substantially constantly against the borehole wall and eliminating vibration and the tendency toward bit whirl.

Figure 5:
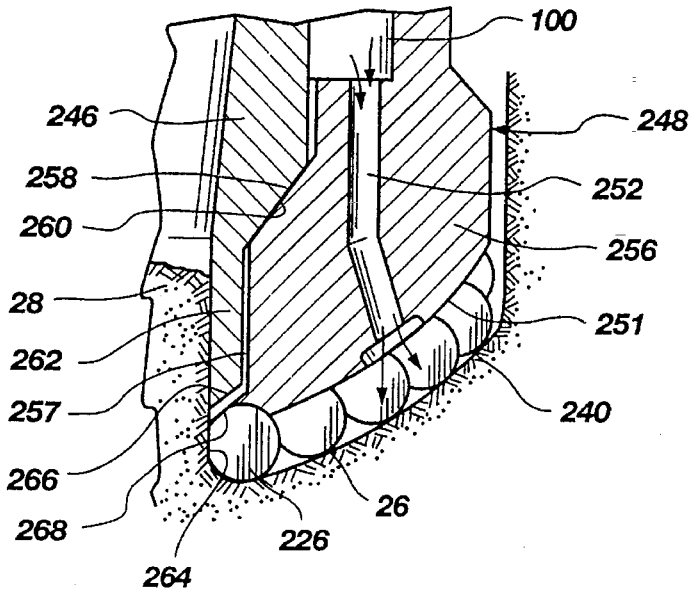
FIG. 5 of the drawings is an enlarged side sectional vertical elevation of an exemplary low-invasion core bit inner gage cutter and cooperating coring shoe arrangement suitable for use with the present invention.

Referring now to FIG. 5 of the drawings, a low-invasion inner gage cutter arrangement on low-invasion core bit 248 is shown with cooperating coring shoe 246 as illustrated in the aforementioned U.S. Pat. No. 4,981,183. Core bit 248 can be a variety of shapes, but preferably has a generally parabolic profile as indicated generally at 251. Alternatively, other profiles can be utilized to advantage. As an example, generally flat sides, giving the bit a generally conical form may be utilized. Body member 256 of core bit 248 includes a plurality of passageways 252 which provide fluid communication between annulus 100 within core barrel 10 and discharge apertures 240 in the face of bit 248. A plurality of cutters 26, preferably PDC cutters, are preferably distributed along the profile of bit 248.

Body member 256 preferably includes a lower bore 257. At least one inner gage cutter 226, and preferably two or three such cutters 226 circumferentially spaced, extend inwardly of the surface defining bore 257 of core bit 248 to cut an inside gage, i.e., the external diameter of a core 28.

Each individual gage cutting element 226 is preferably formed with a flat 264 at this gage dimension, which is smaller than bore 257. Thus, annular lip or pilot section 262 of coring shoe 246 may extend downwardly to a position so that its tip 266 is immediately adjacent the upper edge 268 of cutters 226 within the annular space provided by cutters 226 between the different diameters defined by flats 264 and bore surface 257. Core bit 248 includes a shelf 258 on its inner surface below bore 257, which is contacted by bearing surface 260 and thereby forms a restriction, and ideally substantially a fluid seal, between the rotating bit and the stationary core barrel. With the foregoing arrangement, the core exterior is precisely cut and the core 28 enters the coring shoe 246 immediately upon leaving the upper edges of cutter flats 264. The preferred profile 251 in combination with the orientation and location of the exits of passageways 252 away from the inner gage of the core bit 248 promote improved flushing of formation cuttings as well as minimizing exposure of the core to drilling fluid, thus enhancing both the mechanical and chemical integrity of the core sample. It will be evident to one of ordinary skill in the art that the arrangement of FIG. 2 may be modified to a low-invasion structure by differently configuring the inner gage of core bit 24 and using an extended shoe with a pilot portion, both as shown in FIG. 5. Inner housing 64 of bit end beating assembly may be configured with passages located and oriented to direct fluid to passageways directing fluid to the bit face, rather than the throat or inner gage. Of course, channels 204 on the inner gage, as shown in FIG. 4, would be eliminated.

As wirelines, overshots, overshot couplings, latch couplings and latch assemblies, core catchers, beating assemblies and other core barrel components of a wide variety of designs are well-known in the art, these elements have not been described in detail. Similarly, various bypass valve assemblies of various designs might be employed with core barrel 10 to alternately direct drilling fluid flow through or around inner tube assembly 40 and to permit displacement of fluid by the core, but such devices are entirely conventional as well, familiar to those of ordinary skill in the art, and so will not be illustrated or described.

While the invention has been described in terms of a preferred embodiment, it is not so limited, and many additions, deletions and modifications to the embodiment illustrated and described herein may be made without departing from the scope of the invention as hereinafter claimed.

What is claimed is:

1. An apparatus for alternately coring and drilling of a subterranean formation without tripping of a drill string to which said apparatus is secured, comprising:

an outer barrel assembly including a tubular outer barrel having means at the top thereof for securing the apparatus to the end of a drill string, a latch coupling on the upper interior thereof, and a PDC core bit having a throat and secured to the lower end thereof;

an inner tube assembly configured for placement on the interior of said outer barrel assembly, including coupling means at the top thereof for releasable engagement of a wireline retrieval assembly, a latch assembly for releasable engagement of said latch coupling, a rotational bearing assembly below said latch assembly for permitting mutual rotation between the segments of the inner tube assembly above and below the latch assembly, and an inner tube for receiving a core cut by said core bit; and a center plug assembly configured for placement on the interior of said outer barrel assembly, including coupling means at the top thereof for releasable engagement of a wireline retrieval assembly, a latch assembly for releasable engagement of said latch coupling, a center bit plug at the lowermost end thereof for disposition in said core bit throat, said bit plug having a plug face including PDC cutters disposed thereon and internal passages for receiving drilling fluid from the interior of said outer barrel and directing said drilling fluid to said plug face;

said inner tube assembly and said center plug assembly being interchangeable in said outer barrel assembly to permit, respectively, alternate coring and drilling of said subterranean formation.

2. The apparatus of claim 1, wherein said PDC core bit comprises a stabilized core bit.

3. The apparatus of claim 2, wherein said stabilized core bit comprises an anti-whirl core bit.

4. The apparatus of claim 1, wherein said outer barrel assembly further includes a bit end rotational bearing assembly on the interior thereof above said core bit for alternately receiving the lower end of said inner tube assembly and said center plug assembly.

5. The apparatus of claim 1, wherein said center plug assembly further includes a logging tool.

6. The apparatus of claim 5, wherein said logging tool includes at least one sensing device including capabilities selected from the group comprising: gamma ray logging, directional, pressure, and temperature.

7. The apparatus of claim 5, wherein said logging tool includes data transmission means for transmitting logging data to the surface.

8. The apparatus of claim 7, wherein said data transmission means comprises means for mechanically and electrically engaging a wireline head assembly for transmission of said data to the surface.

9. The apparatus of claim 7, wherein said data transmission means comprises a mud-pulse data transmission assembly.

10. The apparatus of claim 1, wherein said PDC core bit is a low-invasion core bit having inner gage cutters located in close proximity to the lower end of said inner tube when said inner tube assembly is disposed in said outer barrel, and said inner tube includes a coring shoe having a lower portion terminating immediately adjacent said inner gage cutters, and wherein said core bit and said coring shoe are arranged and configured to minimize exposure of a core being cut to drilling fluid.

11. An apparatus for alternate coring and drilling of a subterranean formation without tripping of a drill string to which said apparatus is secured, comprising:

an outer barrel assembly including a tubular outer barrel having means at the top thereof for securing the apparatus to the end of a drill string, a latch coupling on the upper interior thereof, a bit end rotational bearing assembly on the lower interior thereof, and a stabilized PDC core bit having a throat and secured to the lower end thereof;

an inner tube assembly configured for placement on the interior of said outer barrel assembly, including coupling means at the top thereof for releasable engagement of a wireline retrieval assembly, a latch assembly for releasable engagement of said latch coupling, a rotational bearing assembly below said latch assembly for permitting mutual rotation between the segments of the inner tube assembly above and below the latch assembly, and an inner tube for receiving a core cut by said core bit, the lower end of said inner tube being adapted to engage said bit end rotational bearing assembly; and a center plug assembly configured for placement on the interior of said outer barrel assembly, including coupling means at the top thereof for releasable engagement of a wireline retrieval assembly, a latch assembly for releasable engagement of said latch coupling, a center bit plug at the lowermost end thereof having a plug face including PDC cutters disposed thereon, and internal passages for receiving drilling fluid from the interior of said outer barrel and directing said drilling fluid to said plug face, the exterior of said center bit plug being sized to engage said bit end rotational bearing assembly and configured so that said plug face protrudes therebelow into said throat of said core bit to define, with said core bit, a PDC drill bit;

said inner tube assembly and said center plug assembly being interchangeable in said outer barrel assembly to permit, respectively, alternate coring and drilling of said subterranean formation.

12. The apparatus of claim 11, wherein said stabilized core bit comprises an anti-whirl core bit.

13. The apparatus of claim 11, wherein said outer barrel assembly further includes a bit end rotational bearing assembly on the interior thereof above said core bit for alternately receiving the lower end of said inner tube assembly and said center plug assembly.

14. The apparatus of claim 11, wherein said center plug assembly further includes a logging tool.

15. The apparatus of claim 14, wherein said logging tool includes at least one sensing device including capabilities selected from the group comprising: gamma ray logging, directional, pressure, and temperature.

16. The apparatus of claim 14, wherein said logging tool includes data transmission means for transmitting logging data to the surface.

17. The apparatus of claim 16, wherein said data transmission means comprises means for mechanically and electrically engaging said wireline retrieval assembly for transmission of said data to the surface.

18. The apparatus of claim 16, wherein said data transmission means comprises a mud-pulse data transmission assembly.

19. The apparatus of claim 11, wherein said PDC core bit is a low-invasion core bit having inner gage cutters located in close proximity to the lower end of said inner tube when said inner tube assembly is disposed in said outer barrel, and said inner tube includes a coring shoe having a lower portion terminating immediately adjacent said inner gage cutters, and wherein said core bit and said coring shoe are arranged and configured to minimize exposure of a core being cut to drilling fluid.

20. The apparatus of claim 11, wherein said inner tube contains a quantity of non-invasive gel for encapsulation of a core sample entering said inner tube after being cut by said core bit.

* * * * *

UNITED STATES PATENT AND TRADEMARK OFFICE

CERTIFICATE OF CORRECTION

PATENT NO. : 5,568,838

DATED : October 29, 1996

INVENTOR(S) : Struthers et al.

It is certified that error appears in the above-identified patent and that said Letters Patent is hereby corrected as shown below:

In column 1, line 44, change "whiff" to --whirl--;
In column 1, line 45, change "whiff" to --whirl--; change "have" to --having--;
In column 2, line 16, change "society" to --Society--;
In column 2, line 17, change "al" to --al.--;
In column 2, line 21, change "whiff" to --whirl--;
In column 2, line 43, change "masons" to --reasons--;
In column 2, line 46, change "requiting" to --requiring--;
In column 2, line 60, after "wells" insert --,-- (comma);
In column 2, line 63, after "date" insert --,-- (comma);
In column 3, line 13, change "beating" to --bearing--;
In column 3, line 49, insert a hyphen between "while" and "drilling";
In column 4, line 5, change "whiff" to --whirl--;
In column 4, line 23, change "whiff" to --whirl--;
In column 4, line 33, change "are" to --is--;
In column 4, line 50, after "assembly" insert --40--;
In column 4, line 51, change "beating" to --bearing--;
In column 4, line 56, change "FIG." to --FIGS.--;
In column 4, line 60, change "beating" to --bearing--;
In column 4, line 61, after "64" insert --,-- (comma);
In column 5, line 2, after "core bit" insert --24--;
In column 5, line 12, after "FIG.1" insert --,-- (comma);
In column 5, line 30, change "88" to --68--;
In column 5, line 37, after "assembly" insert --40--;
In column 5, line 48, after "on" insert --a--;
In column 5, line 51, after "fluid" insert --is--;
In column 5, line 57, change "reside" to --resides--;
In column 6, line 2, change "carded" to --carried--;
In column 6, line 18, change "renders" to --render--;
In column 6, line 19, delete "measurement";
In column 6, line 55, delete "generally"; after "form" insert --,-- (comma);
In column 7, line 9, change "below" to --above--;
In column 7, line 10, after "surface 260" insert --of coring shoe 246--;

UNITED STATES PATENT AND TRADEMARK OFFICE

CERTIFICATE OF CORRECTION

PATENT NO. : 5,568,838

DATED : October 29, 1996

INVENTOR(S) : Struthers et al.

It is certified that error appears in the above-identified patent and that said Letters Patent is hereby corrected as shown below:

In Column 7, line 25, "beating" should read --bearing--.

In column 7, line 25, after "assembly" insert --36--;

In column 7, line 32, change "beating" to --bearing--.

Signed and Sealed this

Sixth Day of July, 1999

*Attest:*

Q. TODD DICKINSON

*Attesting Officer*

*Acting Commissioner of Patents and Trademarks*